United States Patent [19]

Thaler et al.

[11] Patent Number: 4,675,639

[45] Date of Patent: Jun. 23, 1987

[54] TRANSFORMER ASSEMBLY AND WINDING THEREFOR

[75] Inventors: Barry J. Thaler, Lawrenceville; Edward Mykietyn, Trenton, both of N.J.; James R. Young, Indianapolis, Ind.

[73] Assignee: RCA Corporation, Princeton, N.J.

[21] Appl. No.: 732,606

[22] Filed: May 10, 1985

[51] Int. Cl.[4] ..... H01F 15/10; H01F 27/30

[52] U.S. Cl. ..... 336/185; 29/605; 336/192; 336/208

[58] Field of Search ..... 336/192, 198, 208, 184, 336/185; 174/94 R; 310/71; 29/605

[56] References Cited

U.S. PATENT DOCUMENTS

| | | | |
|---|---|---|---|
| 3,238,351 | 3/1966 | Hill | 219/86 |
| 3,519,778 | 7/1970 | Gibson, Jr. | 219/58 |
| 3,627,970 | 12/1971 | Weatherman | 219/91 |
| 3,947,795 | 3/1976 | Donnelly et al. | 336/192 X |
| 4,039,924 | 8/1977 | Scales et al. | 363/65 |
| 4,091,349 | 5/1978 | Niederjohn et al. | 336/192 |
| 4,151,500 | 4/1979 | Malerba et al. | 336/198 X |
| 4,274,136 | 6/1981 | Onodena et al. | 336/208 X |
| 4,388,513 | 6/1983 | Brastow et al. | 219/58 |
| 4,396,819 | 8/1983 | Muchkin et al. | 219/91.21 |
| 4,419,814 | 12/1983 | Hasserjian | 336/198 X |
| 4,462,016 | 7/1984 | Bland et al. | 336/208 X |
| 4,465,913 | 8/1984 | Stokoe | 219/56.1 |
| 4,547,759 | 10/1985 | Muller | 336/192 |

FOREIGN PATENT DOCUMENTS

| | | | |
|---|---|---|---|
| 1392960 | 2/1965 | France | 336/192 |
| 2394877 | 2/1979 | France | 336/192 |

*Primary Examiner*—Thomas J. Kozma

*Attorney, Agent, or Firm*—Paul J. Rasmussen; Joseph Laks; Stevens Scott J.

[57] ABSTRACT

A high voltage transformer for a video display apparatus includes a bobbin-wound tertiary winding. The bobbin incorporates integral nonmetallic terminal posts about which the winding segment wire is wound and terminated. The winding segments are interconnected by electrical components. The component leads incorporate a solder coating and are flattened to provide a large bonding area with the wire on the terminal posts. The component lead overlays the winding segment wire and is joined thereto by a fusion bonding process. The fusion bonding removes the wire insulations and melts the component lead solder coating to form a reflow solder joint.

12 Claims, 9 Drawing Figures

TRANSFORMER ASSEMBLY AND WINDING THEREFOR

This invention relates to the design and construction of transformers and, in particular, to high voltage transformers for use in video display apparatus.

Video display apparatus, such as television receivers and computer monitors, may include a transformer that produces a high voltage potential for application to the high voltage or ultor terminal of the video display apparatus cathode ray tube. This high voltage transformer incorporates a primary winding to which is applied the horizontal rate retrace pulses from the horizontal deflection circuit of the video display apparatus. The high voltage transformer also incorporates a high voltage or tertiary winding which steps up and rectifies the primary winding pulse voltage to produce a high voltage level of the order of 25,000 volts.

The high voltage levels generated by the transformer and the high voltage stresses encountered by the transformer winding and components require that the transformer be constructed to extremely close tolerances. Reliable operation of the video display apparatus requires that the operating characteristics of the high voltage transformer be predictable from one transformer to another. Manufacturing reproducibility is therefore important.

In order to reduce the costs associated with the manufacture of the high voltage transformer, it is desirable to automate as much of the assembly as possible. The design of the transformer, however, must be adapted for automated assembly so that the construction does not require unduly complex or costly equipment.

In accordance with an aspect of the present invention, a transformer for use in a video display apparatus comprises a winding bobbin having integral nonmetallic terminal posts. A coil segment is wound on the bobbin and has a number of wire turns wound on one of the terminal posts. A conductor lead overlays and is electrically connected to the wire turns on the terminal post.

In the accompanying drawing.

Figure 1:
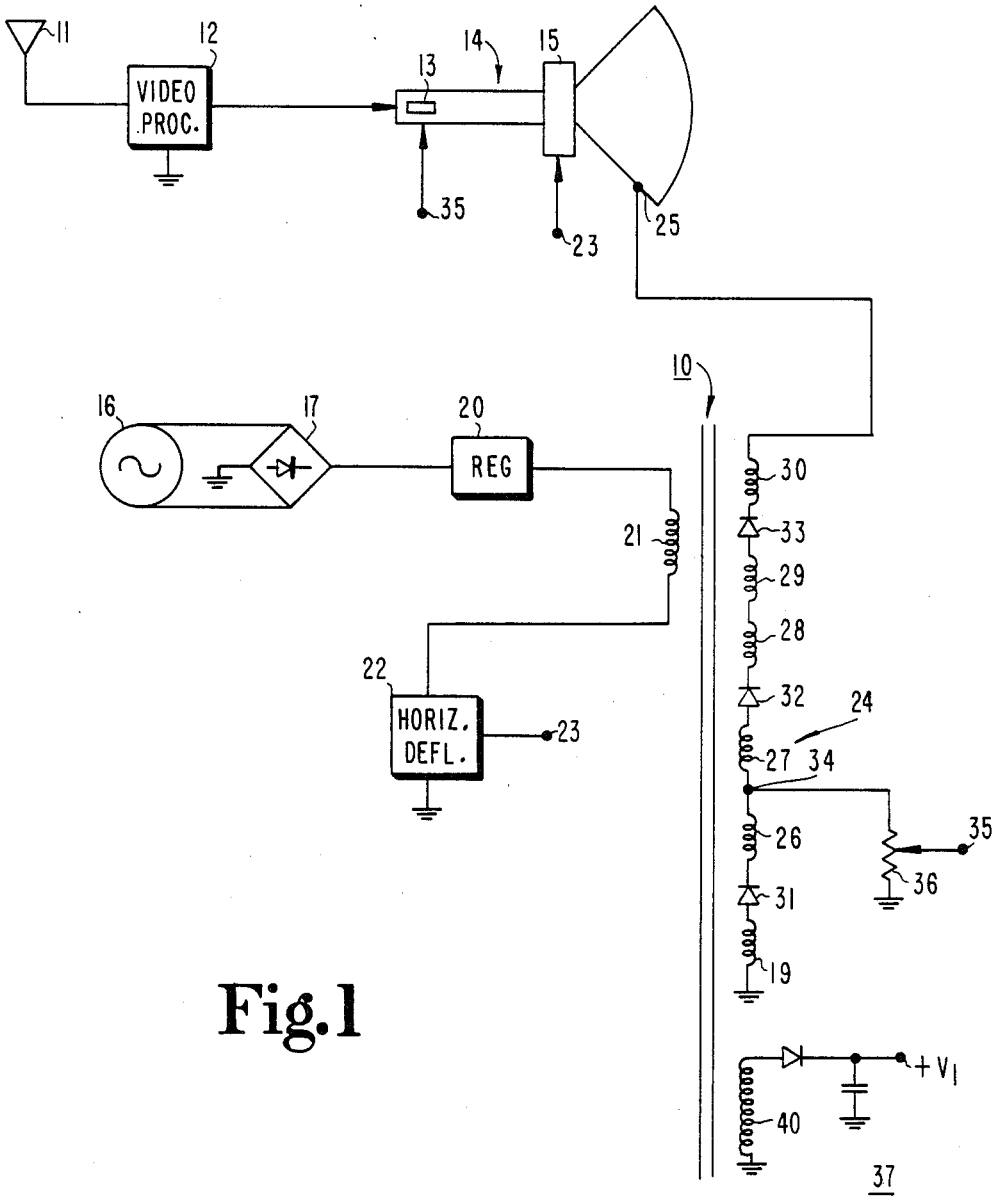
FIG. 1 is a schematic and block diagram of a portion of a video display apparatus including a high voltage transformer.

Referring to FIG. 1, there is shown a portion of a video display apparatus including a high voltage transformer 10. Video signals are illustratively received via an antenna 11 and are applied to video processing circuitry 12, which demodulates and decodes the signal in an appropriate manner for application to the electron gun assembly 13 of a cathode ray tube 14. Electron gun assembly 13 illustratively produces three electron beams, which are deflected to form a scanned raster by deflection yoke 15.

A source of AC voltage 16 is coupled to a rectifying circuit 17 which produces an unregulated DC voltage level that is applied to a regulator circuit 20. Regulator 20 may illustratively be of various types, such as switched-mode or SCR regulators. The output of regulator 20 is a regulated DC voltage that is applied to one terminal of a primary winding 21 of high voltage transformer 10. The other terminal of primary winding 21 is coupled to a horizontal deflection circuit 22 which generates horizontal deflection signals that are applied to the horizontal deflection windings of deflection yoke 15 via terminal 23.

High voltage transformer 10 includes a high voltage winding 24 which produces a high voltage level that is applied to an anode terminal 25 of picture tube 14. High voltage winding 24 illustratively comprises winding segments 19, 26, 27, 28, 29 and 30 with rectifying diodes 31, 32 and 33 separating the winding segments. A tap 34 on high voltage winding 24 provides a focus voltage that is applied to electron gun assembly 13 via a terminal 35. The focus voltage is supplied from tap 34 to terminal 35 via an adjustable resistor 36.

High voltage transformer 10 also includes a load circuit power supply 37 which, via winding 40 and appropriate rectifying diodes and filtering capacitors, produces a voltage level $+V_1$ which may be used to power other circuitry (not shown) of the video display apparatus.

Figure 2:
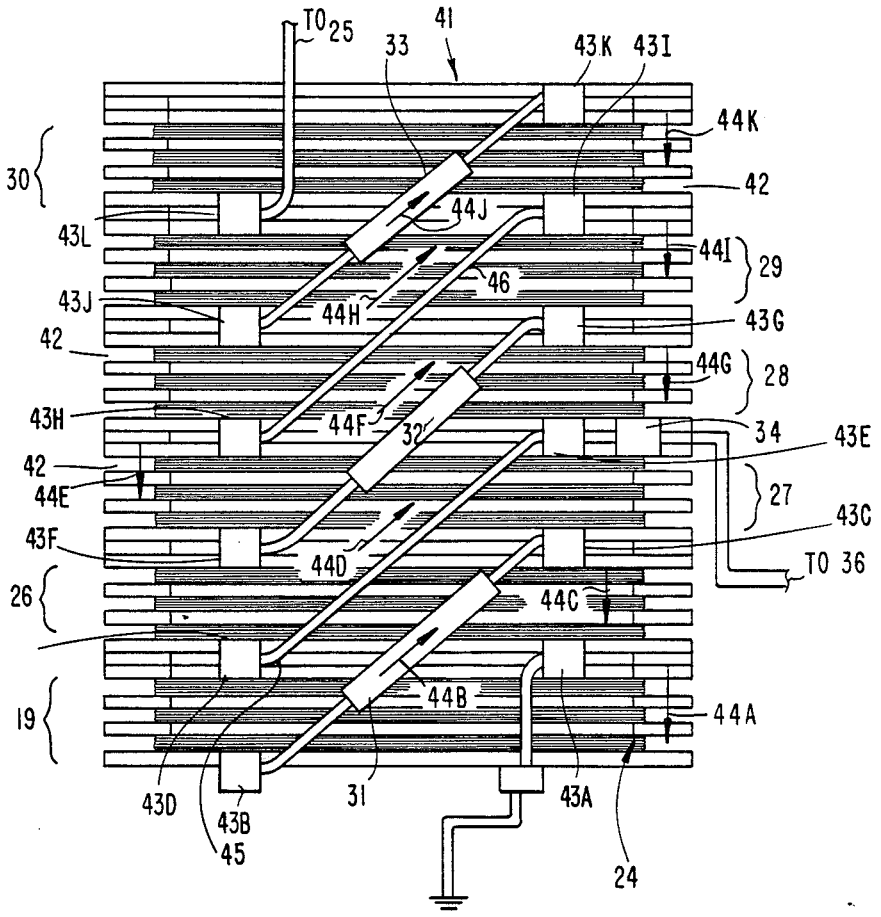
FIG. 2 is an elevational view of a part of a high voltage transformer constructed in accordance with an aspect of the present invention.

In accordance with an aspect of the present invention, FIG. 2 illustrates a bobbin 41, on which is wound high voltage or tertiary winding 24. The individual turns of high voltage winding 24 are wound in slots 42 of bobbin 41 to form the winding segments 19, 26, 27, 28, 29 and 30. Each winding segment is terminated by attachment to nonmetallic terminal posts 43. For example, winding segment 19 is terminated at terminal posts 43A and 43B.

When transformer primary winding 21 is energized, voltage is induced across the winding segments of high voltage winding 24 in the directions indicated by arrows 44A–44K. Specifically, the voltage will increase from ground to the high voltage level via the following path: Terminal post 43A, winding segment 19, terminal post 43B, diode 31, terminal post 43C, winding segment 26, terminal post 43D, jumper wire 45, terminal post 43E, winding segment 27, terminal post 43F, diode 32, terminal post 43G, winding segment 28, terminal post 43H, jumper wire 46, terminal post 43I, winding segment 29, terminal post 43J, diode 33, terminal post 43K, winding segment 30, terminal post 43L, to cathode ray tube ultor terminal 25. Terminal post 34, which provides the tap for the focus voltage, is electrically connected to terminal post 43E.

The locating of diodes 31, 32 and 33, and jumper wires 45 and 46 in such a manner that they cross or bridge the winding turns of the winding segments of high voltage winding 24 requires that the winding of high voltage winding 24 be completed before placement of the diodes and jumper wires is made. The advantageous manner in which the diode and jumper wire leads are electrically connected to the wire of each of the winding segments of high voltage winding 24 will be described with reference to FIGS. 3A–3E.

Figure 3A:
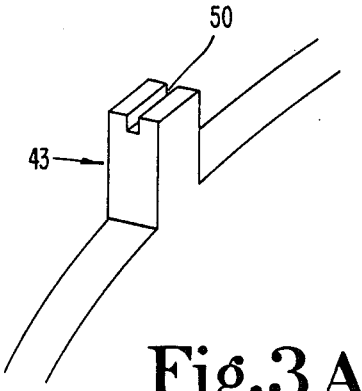
FIGS 3A–3E are isometric views of a portion of a high voltage transformer illustrating various aspects of the present invention.
Figure 3B:
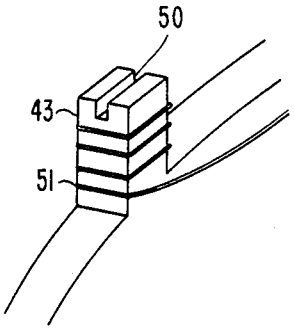

Terminal posts 43A–43L are formed as integral parts of bobbin 41. Illustratively, bobbin 41 is molded of a plastic material, such as Noryl®, which is manufactured by the General Electric Corporation. As can be illustratively seen in FIG. 3A, terminal posts 43A–43L, represented by generic terminal post 43, have a square or rectangular cross section with a slot 50 formed in a downward direction from the upper surface of the terminal post. A length of wire 51 from one of the winding segments of high voltage winding 24 is wound about the perimeter of terminal post 43. As can be seen in FIG. 3B, wire 51 is bent around each corner of terminal post 43 in one or more turns as required for retaining wire 51 adjacent to terminal post 43. This bending causes wire 51 to grip terminal post 43 so that wire 51 is temporarily held in place without the need for adhesive or other means. In the winding structure of FIG. 2, each winding segment is terminated at respective terminal posts. Interconnection of winding segments is then accomplished by connections between terminal posts via diodes 31, 32 and 33 or jumper wires 45 and 46, for example.

Figure 3C:
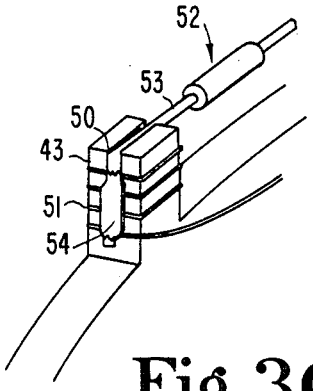
Figure 3D:
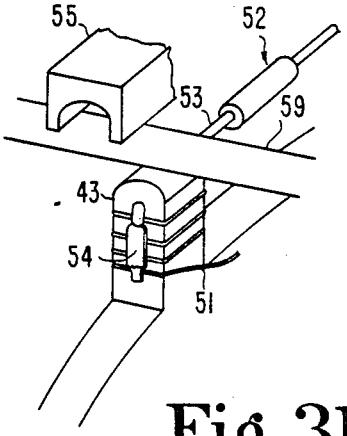

FIG. 3C illustrates a representative interconnection component 52. The lead 53 of component 52 is inserted in slot 50 of terminal post 43. Slot 50 easily accommodates automatic component insertion arrangements for efficient assembly of transformer 10. The portion of lead 53 that extends beyond the end of slot 50 is bent downward to overlay the wire 51 on one side of terminal post 43. The part of lead 53 that overlays wire 51 advantageously comprises a reflowable coating, such as tin or solder. Illustratively, lead 53 is dipped in solder to provide a solder coating 54, and flattened to provide a larger bonding area with improved heat transfer properties with respect to a round wire. Component lead 53 is held in place within slot 50 of terminal post 43 by heat sealing slot 50 using conventional techniques by the use of a heat sealing tool 55, as shown in FIG. 3D. A layer of Teflon® tape 59 may be positioned between heat sealing tool 55 and terminal post 43 during the heat sealing process in order to maintain a clean surface on heat sealing tool 55.

Figure 3E:
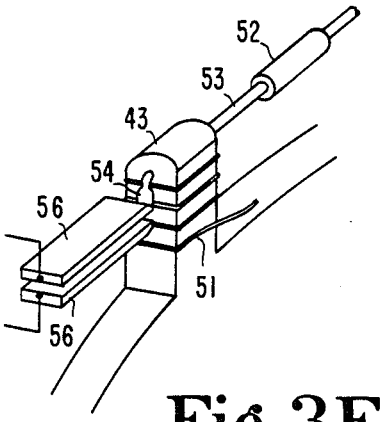
Figure 4:
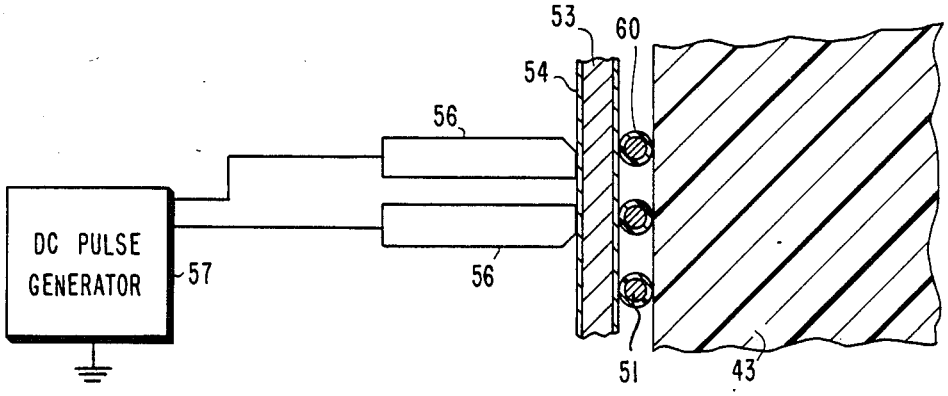
FIG. 4 illustrates details of the fusion bonding process used in accordance with the present invention.

Component lead 53 is electrically connected to wire 51 by way of a fusion bonding process described in greater detail with reference to FIG. 4. As shown in FIG. 3E and FIG. 4, spaced electrodes 56 are placed in contact with the flattened part of component lead 53. A DC pulse from DC pulse generator 57 is applied to electrodes 56. The flattened part of component lead 53 provides good interfacial resistance with the contacting surface of electrodes 56. This interfacial resistance, necessary for a satisfactory bond, causes flattened component lead 53 to become heated by the DC pulse. Heated component lead 53 causes the insulation 60, which may illustratively be a polyurethane insulation, on wire 51 to be melted and displaced, thereby creating a clean metal surface. Heating of component lead 53 also melts or reflows the solder coating 54 such that component lead 53 and wire 51 become soldered together, forming a strong bond. Flattening of lead 53 provides good heat transfer such that insulation 60 is displaced and solder 54 is melted substantially without melting or deforming the plastic of terminal post 43. A single DC pulse, therefore, by virtue of the previously described interfacial resistance, performs the functions of displacing the insulation 60 from wire 51 and melting the solder coating 54 on component lead 53 to form the desired solder bond between lead 53 and wire 51. Because insulation 60 is displaced at the time the solder joint is made, the wire 51 remains covered and clean until the bond is formed. Therefore no flux is required to produce an electrical satisfactory connection. Electrodes 56 may be advantageously constructed of tungsten. Other electrode materials may include molybdenum carbide or a copper alloy. Such electrodes are commercially available from various manufacturers.

Figure 5:
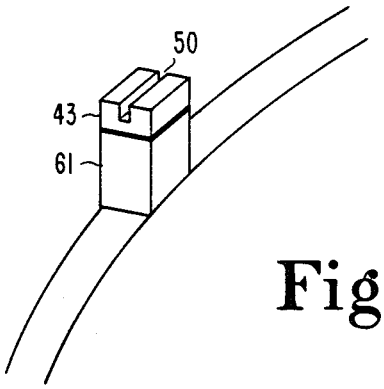
FIG. 5 is an isometric view of a portion of a high voltage transformer illustrating another aspect of the present invention.

FIG. 5 illustrates an alternate embodiment in which a layer of metallic foil 61 is placed around a portion or the whole of each of the terminal posts prior to wrapping with wire 51. Foil 61 provides an additional bonding surface such that component lead 53, wire 51 and foil 61 all form a single electrical joint.

The previously described arrangement for the placement of components that interconnect winding segments of transformer winding 24 may of course be advantageously utilized with other winding arrangements. The particular winding arrangement described is for illustrative purposes only.

What is claimed is:

1. A high voltage transformer for a video display apparatus comprising:

a bobbin incorporating a plurality of integral nonmetallic terminal posts, each of said posts having a slot formed therein;

a plurality of winding segments wound on said bobbin, each of said winding segments comprising a plurality of winding turns, a length of wire from one of said winding turns being wound on said terminal posts; and electrical conductor means disposed between two of said terminal posts for electricall connecting said winding segments, a first portion of said electrical conductor means being disposed within said slot of said terminal post, a second portion of said conductor means being bent so as to overlay said length of wire wound on said terminal post for being electrically connected thereto.

2. The arrangement defined in claim 1, wherein said terminal posts are formed as a part of said bobbin.

3. The arrangement defined in claim 1, wherein said terminal posts are nonmetallic.

4. The arrangement defined in claim 1, wherein said terminal posts have a rectangular cross-sectional area.

5. The arrangement defined in claim 1, wherein said terminal posts incorporate slots formed in a downward direction from the upper surface thereof for receiving portions of said electrical conductor means.

6. The arrangement defined in claim 1, wherein said wire comprising said winding segments incorporates an insulating coating.

7. The arrangement defined in claim 6, wherein said portion of said electrical conductor means overlaying said length of wire comprises an enlarged area for providing an increased contact area with said length of wire.

8. The arrangement defined in claim 7, wherein said portion of said electrical conductor means and said length of wire are electrically joined.

9. The arrangement defined in claim 1, wherein said winding segments are electrically terminated at respective ones of said terminal posts.

10. A high voltage transformer for a video display apparatus comprising:

a bobbin incorporating a plurality of integral nonmetallic posts, each having a slot formed therein;

a plurality of winding segments wound on said bobbin, each of said winding segments comprising a plurality of winding turns, a length of wire from one of said winding turns being wound on said terminal posts said length of wire incorporating an insulating coating; and electrical conductor means disposed between two of said terminal posts for electrically connecting said winding segments, a first portion of said electrical conductor means being disposed within said slot, a second portion of said electrical conductor means incorporating reflowable metallic coating deposited thereon, said second portion of said electrical conductor means being enlarged and bent to overlay said length of wire wound on said terminal post, said second portion of said electrical conductor means and said length of wire being electrically connected such that said insulating coating is displaced and said reflowable metallic coating is melted.

11. The arrangement defined in claim 1, wherein said slot of said terminal post is closed such that said first portion of said electrical conductor means is captivated by said terminal post.

12. The arrangement defined in claim 10, wherein said second portion of said electrical conductor means comprises a length of flattened round wire.

* * * * *